US009550079B2

(12) United States Patent
D'Angelo

(10) Patent No.: US 9,550,079 B2
(45) Date of Patent: Jan. 24, 2017

(54) MULTILEVEL RAILCAR SAFETY CATCH SYSTEM

(76) Inventor: Theresa H. D'Angelo, Grand Island, NY (US)

( * ) Notice: Subject to any disclaimer, the term of this patent is extended or adjusted under 35 U.S.C. 154(b) by 581 days.

(21) Appl. No.: 13/324,236

(22) Filed: Dec. 13, 2011

(65) Prior Publication Data

US 2013/0146395 A1 Jun. 13, 2013

(51) Int. Cl.

| | |
|---|---|
| ***B61D 49/00*** | (2006.01) |
| ***A62B 1/22*** | (2006.01) |
| ***B61D 3/18*** | (2006.01) |
| ***E04G 21/32*** | (2006.01) |

(52) U.S. Cl.

CPC ..... *A62B 1/22* (2013.01); *B61D 3/187* (2013.01); *E04G 21/3261* (2013.01)

(58) Field of Classification Search

CPC .... B60P 7/0876; B63B 27/36; E04G 21/3261; B61D 3/187

USPC ..... 105/425, 458, 459; 114/362; 182/137, 182/138, 139, 140

See application file for complete search history.

(56) References Cited

U.S. PATENT DOCUMENTS

| | | | | |
|---|---|---|---|---|
| 2,024,904 | A * | 12/1935 | Amesbury | 182/113 |
| 3,533,487 | A * | 10/1970 | Norin | 182/19 |
| 4,805,735 | A * | 2/1989 | Anderson | 182/138 |
| 4,854,419 | A * | 8/1989 | Lyras et al. | 182/129 |
| 5,010,614 | A | 4/1991 | Braemert et al. | |
| 5,167,299 | A | 12/1992 | Nusbaum | |
| 5,429,206 | A | 7/1995 | Nusbaum | |
| 5,471,935 | A * | 12/1995 | Goebels et al. | 105/458 |
| 5,596,936 | A * | 1/1997 | Bullock et al. | 105/458 |
| 5,673,769 | A * | 10/1997 | Rexroad et al. | 182/138 |
| 6,035,967 | A * | 3/2000 | Maeda | 182/138 |
| 6,044,595 | A * | 4/2000 | Snow | 52/101 |
| 6,161,648 | A * | 12/2000 | Rexroad et al. | 182/138 |
| 6,305,310 | B1 | 10/2001 | Ferri | |
| 8,459,683 | B2 * | 6/2013 | Junke | 280/403 |
| 2002/0104710 | A1 * | 8/2002 | Thompson et al. | 182/138 |

* cited by examiner

*Primary Examiner* — Colleen M Chavchavadze

(74) *Attorney, Agent, or Firm* — Vincent G. LoTempio; Kloss, Stenger & LoTempio; David T. Stephenson

(57) ABSTRACT

The multilevel railcar safety catch system of the present disclosure comprises at least two multilevel railcars (or at least one multilevel railcar and a vehicle loading ramp), at least two bridge plates, and a safety catch assembly. In the preferred embodiment of the disclosure, two or more multilevel railcars are coupled together by a coupler. Two bridge plates are laid across the gap between corresponding multilevel railcar decks for the purpose of walking or moving vehicles across from one multilevel railcar to another. A safety catch assembly is removably attached underneath the bridge plates via a securement means on the safety catch assembly and barrel rings or bridge plate hinge pins in such a way as to prevent persons or items from falling through the gap between the multilevel railcar decks when loading or unloading vehicles.

4 Claims, 7 Drawing Sheets

MULTILEVEL RAILCAR SAFETY CATCH SYSTEM

FIELD OF THE INVENTION

The present disclosure relates to safety nets, and more particularly to a new multilevel railcar safety catch system for catching persons or items falling between the bridge plates positioned between two multilevel railcars or on a vehicle loading ramp.

BACKGROUND OF THE INVENTION

The basic concept of a safety net is well known in the prior art. Safety nets have been developed and utilized to meet numerous objectives and requirements. Prior safety net designs include U.S. Pat. Nos. 7,464,962, 6,305,310, 5,429,206, 5,167,299, 4,838,382 and 4,372,243.

However, none of the above prior art patents discloses a new multilevel railcar safety catch system. The new device includes at least one multilevel railcar or vehicle loading ramp, a plurality of bridge plates, and a safety catch assembly which is removably coupled to the multilevel railcar or loading ramp, positioned such that the safety catch assembly extends between the plurality of bridge plates for the purpose of preventing persons or items from falling through the gap between the bridge plates.

Multilevel railcars are used to transport automobiles from plant sites and automobile origin locations to destinations for offloading. Once a multilevel railcar arrives at a destination facility, multiple multilevel railcars are generally connected together via a coupler. An individual worker will then manually join multilevel railcar decks together via bridge plates. A vehicle loading ramp is attached to the first or the last multilevel railcar in line, and vehicles are either loaded or unloaded across the plurality of multilevel railcars by workers driving and walking through one multilevel railcar and across the bridge plates to the next multilevel railcar.

The above scenario presents a severe safety hazard for the individual loading and unloading vehicles from the multilevel railcars, as said individual must be careful to navigate a gap between the bridge plates that couple the decks of the multilevel railcars together. Multilevel railcar workers risk severe injury or death from a fall between bridge plates. On average, the height of the first deck of a multilevel railcar is three feet off the ground, the height of the second deck is ten feet off the ground, and the height of a third deck (if equipped) is fifteen to eighteen feet off the ground. In addition to the height of the multilevel railcar decks posing a hazard, any fall takes place directly over the coupler attaching the multilevel railcars together. Workers often have to manually push vehicles that cannot be moved under their own power across/off their decks, and falls commonly occur due to the following factors: loss of balance when walking over narrow bridge plates, adverse weather conditions (such as icy, wet, or windy conditions), slick surfaces caused by oil or grease, and simply forgetting there is a gap between bridge plates when walking between multilevel railcars.

Some companies, including Toyota Canada, have solved the problem of workers falling through the bridge plate gap between coupled multilevel railcars by only allowing the loading and unloading of one multilevel railcar at a time. However, this solution is very costly in terms of the extra time it takes to implement, and in terms of the environmental toll of constantly splitting the multilevel railcars. Each multilevel railcar must be uncoupled from one another. A locomotive then moves a vehicle loading ramp into place, which is attached to the first multilevel railcar for loading/unloading. Afterwards, the vehicle loading ramp is detached and moved out of the way so the first multilevel railcar can be moved to a different track. The vehicle loading ramp is then brought back to hook up with the next multilevel railcar in line, and the lengthy process continues. In addition, there still exists the problem of a hazardous gap along the loading ramp.

An additional rail yard workplace hazard involves a gap between the bridge plates of vehicle loading ramps. Similar to the multilevel railcar bridge plate safety hazard in that falls routinely occur due to lost balance, adverse weather, slick surfaces, and people forgetting there is a gap when moving from the multilevel railcar deck to the loading ramp, there is the additional threat of an inclined/declined surface to navigate. The above inventor has attempted to solve this problem by extending ramp grating, or by welding pieces of chain link fence, from one ramp plate to the next. However, this solution is inadequate because the design of the loading ramp does not allow for the ramp grating to be fully extended across the gap, and it is often impracticable to implement given the personnel and resources available. Also, this solution dangerously encourages workers to get in the habit of being able to walk down the middle of one ramp that happens to be modified, while the majority of ramps in the industry still have a gap in the center.

Thus it is readily apparent that there is a long felt need in the industry for a new multilevel railcar safety catch system that overcomes deficiencies in the prior art in the following ways, such as: 1) the system prevents persons and/or objects from falling through the bridge plate gap between coupled multilevel railcars; 2) the system prevents persons and/or objects from falling through the bridge plate gap on a vehicle loading ramp; 3) the system is easy to setup, utilizing existing multilevel railcar parts standard in the art; 4) the system is lightweight and portable; 5) the system is flexible enough to arch over a multilevel railcar coupler, and 6) the system allows for the drainage of water and the melting of ice or snow. The present disclosure satisfies the above-mentioned needs, as well as others, and overcomes the deficiencies in devices heretofore developed.

SUMMARY OF THE INVENTION

The current disclosure presents a new multilevel railcar safety catch system which is primarily used for preventing persons and/or objects from falling through the gap between the decks of coupled multilevel railcars. The general purpose of the present disclosure, to be subsequently described in greater detail, is to provide a safety catch system which has many of the advantages of the safety nets previously disclosed, in addition to many novel features, yielding a multilevel railcar safety catch system that is not anticipated by any one or combination of multiple prior art safety nets.

The new multilevel railcar safety catch system is generally comprised of at least two multilevel railcars (or at least one multilevel railcar and a vehicle loading ramp), at least two bridge plates, and a safety catch assembly. The two bridge plates connect one deck of a first multilevel railcar to the corresponding deck of a second multilevel railcar. The catch assembly is removably coupled and positioned such that the catch assembly extends between the bridge plates for the purpose of preventing persons or items from falling through the gap between the bridge plates and rail cars. The catch assembly is preferably attached via rings which are slidenly engaged by the barrel pin used to secure the bridge plates to the multilevel railcar barrel rings.

It is a general object of the present disclosure to provide a new multilevel railcar safety catch system that has many of the advantages of the safety nets mentioned heretofore and many new features that will efficiently prevent persons or object from falling between bridge plates on multilevel railcars.

It is another object of the present disclosure to provide a system that will overcome the shortcomings of the prior safety net systems.

It is still another object of the present disclosure to provide a safety catch system that is easy to setup, utilizing existing multilevel railcar parts standard in the art.

It is yet another object of the present disclosure to provide a safety catch system that is lightweight and portable.

It is another object of the present invention to provide a safety catch system that is flexible enough to arch over a multilevel railcar coupler.

It is a further object of the present disclosure to provide a safety catch system that allows for the drainage of water and the melting of ice or snow.

These and other objects, features, and advantages of the present invention will become apparent upon a reading of the detailed description and claims in view of the several drawing figures.

BRIEF DESCRIPTION OF THE DRAWINGS

The disclosure is explained below by means of schematic drawings (see attached) and with additional details. The drawings include.

DETAILED DESCRIPTION OF THE INVENTION

Figure 1:
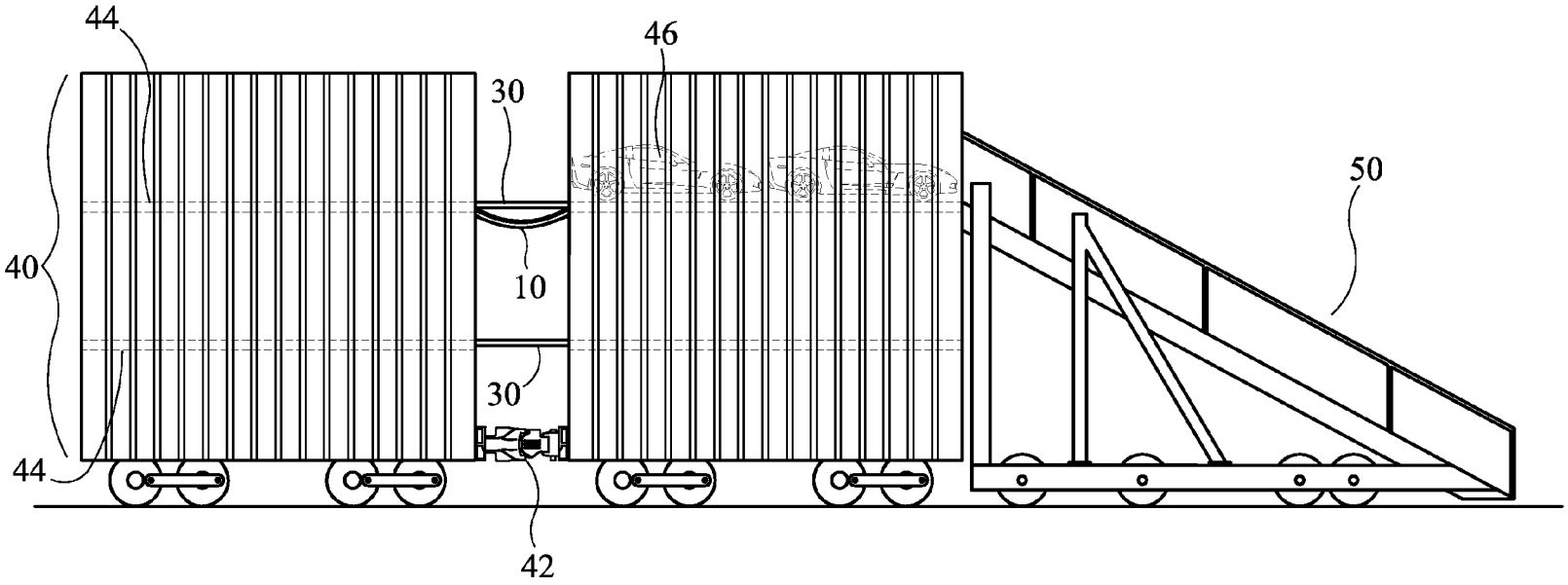
FIG. 1 is a side perspective view of the multilevel railcar safety catch system according to the disclosure.

Description of Multilevel Railcar Safety Catch System

At the outset, it should be clearly understood that like reference numerals are intended to identify the same structural elements, portions, or surfaces consistently throughout the several drawing FIGS., as may be further described or explained by the entire written specification of which this detailed description is an integral part. The drawings are intended to be read together with the specification and are to be construed as a portion of the entire "written description" of this invention as required by 35 U.S.C. §112.

The multilevel railcar safety catch system of the present disclosure comprises at least two multilevel railcars (or at least one multilevel railcar plus a vehicle loading ramp), at least two bridge plates, and a safety catch assembly. In the preferred embodiment of the disclosure, two or more multilevel railcars are coupled together by a coupler. Two bridge plates are laid across the gap between corresponding multilevel railcar decks for the purpose of walking or moving vehicles across from one multilevel railcar to another. A safety catch assembly is removably attached underneath the bridge plates via a securement means on the safety catch assembly and barrel rings or bridge plate hinge pins in such a way as to prevent persons or items from falling through the gap between the multilevel railcar decks when loading or unloading vehicles.

Multilevel railcars are used to ship automobiles from plant sites and auto origin locations to destinations for offloading. Once the multilevel railcar arrives at a destination facility, the multilevel railcars are connected together via a coupler. This coupler is the only stationary permanent device between the two multilevel railcars, and is also a primary hazard in the event someone or something was to fall from a height on top of it.

A multilevel railcar has two or three decks (or floors), and vehicles are secured to the deck of each multilevel railcar for transportation. During loading and unloading, multilevel railcars are matched together by deck heights and are attached by a coupler. Once coupled together, an individual multilevel railcar worker will open and secure the multilevel railcar doors, then climb up the side of the multilevel railcar on a stationary mounted ladder. Once said individual has reached the desired multilevel railcar deck, the individual will adjoin the adjacent multilevel railcar deck by installing two portable bridge plates.

The bridge plates are installed by laying one end of a bridge plate across the surface of a multilevel railcar deck, and securing the other end of the bridge plate on the opposing multilevel railcar deck by sliding a solid metal bridge plate hinge pin alternately through barrel rings attached to both the multilevel railcar deck and to the bridge plate itself. In the preferred embodiment of the present disclosure, the individual multilevel railcar worker will secure a safety catch assembly to the multilevel railcar deck by sliding said bridge plate hinge pin through safety catch assembly rings simultaneously with securing said bridge plate hinge pin to said barrel rings. On the opposing multilevel railcar deck, said safety catch assembly will preferably be coupled to the unused barrel rings attached to the opposing multilevel railcar deck by means of a securement device such as a carabiner. A number of additional examples of use and means of connection will be readily apparent to those skilled in the art.

The safety catch assembly is generally comprised of a safety catch fabric, a plurality of connection grommets, and a plurality of securement devices. Another embodiment of the safety catch assembly will also include a plurality of rigid bars. The safety catch fabric is preferably constructed from a lightweight woven or semi-porous material that will sustain the weight of an individual, will allow for the drainage of water cause by spillage, rain, or the melting of snow or ice, and will flex over a multilevel railcar coupler, if necessary, thereby affording protection at all multilevel railcar deck heights.

In the preferred embodiment of the disclosure, the safety catch fabric will measure between thirty-eight and forty-six inches in length by eighty inches in width (38"-46"×80"), which will allow the safety catch assembly to fit securely on any coupled multilevel railcars meeting the standard guidelines set forth by the Association of American Railroads' (AAR) Manual on Portable Bridge Plates for Multi-Level Autorack Cars. In additional embodiments of the safety catch assembly, the size of the safety catch fabric can be adjusted to fit multi-level railcars of different standards.

In one embodiment of the disclosure, the safety catch fabric will have a rigid bar along each end of said fabric's width. The purpose of said rigid bars is to allow the safety catch assembly to sit flush against the multilevel railcar deck, with minimal gapping. The safety catch fabric has a plurality of connection grommets running along the width and adjacent to said rigid bars, which serve as areas of attachment for the plurality of securement devices. In the preferred embodiment of the disclosure, said safety catch fabric is configured with four (4) connection grommets along each width, for a total of eight (8) connection grommets, each with a corresponding securement device. In the preferred embodiment, the spacing along each end of the safety catch fabric of the first and second connection grommets shall preferably be between seventeen and eighteen inches (17"-18") apart on center, approximately forty-three inches (43") between the second and third connection grommets, and approximately seventeen and eighteen inches (17"-18") between the third and fourth connection grommets. The preferred spacing will provide for a taut assembly, as well as allow for proper attachment to standard bridge plate hinge pin and barrel ring assemblies, though the spacing can be altered in additional embodiments to comply with additional barrel ring standards.

In addition to providing an individual with protection from falling through the gap between the decks of two coupled multilevel railcars, another embodiment of the multilevel railcar safety catch system provides an individual with protection from falling through the gap between two bridge plates of a vehicle loading ramp (e.g. a Buck or Lesco loading ramp). In the instant embodiment, said vehicle loading ramp will need to be retrofitted with a plurality of sleeves or hooks similar to barrel rings, welded along the bottom of each bridge plate, said plurality of sleeves or hooks to serve as attachment points for the safety catch assembly.

Averting now to the drawings, with reference to FIG. 1, side perspective view is depicting the multilevel railcar safety catch system according to the disclosure. A first multilevel railcar 40 is connected to second multilevel railcar 40 via a coupler 42. A plurality of vehicles 46 are shown resting on multilevel railcar deck 44, and are loaded onto and unloaded off of multilevel railcar 40 via a vehicle loading ramp 50. Vehicles 46 are moved from first multilevel railcar 40 to second multilevel railcar 40 (and to any subsequent multilevel railcars, not shown) via bridge plates 30. When an individual worker (not shown) maneuvers on foot from multilevel railcar 40 to multilevel railcar 40 via said bridge plates 30, safety catch assembly 10 protects said individual worker in the case of an accident from falling onto coupler 42 through a gap between the multilevel railcars 40 and bridge plates 30 (see FIGS. 3, 4). FIG. 1 depicts multilevel railcar 40 capable of holding two vehicles 46 per multilevel railcar deck 44, however the preferred embodiment of the disclosure is compatible with any size multilevel railcar allowed under standard AAR guidelines.

Figure 2:
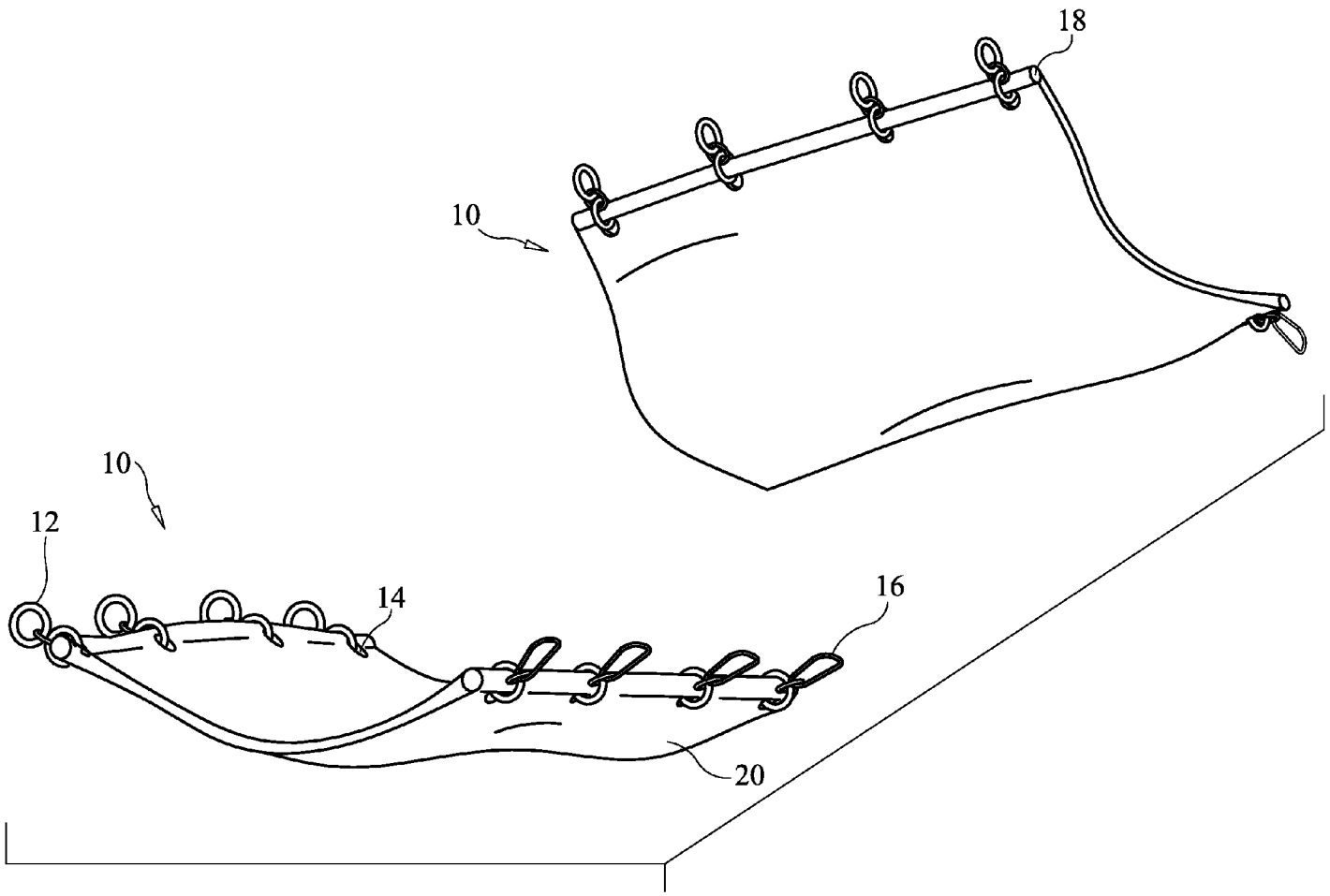
FIG. 2 is a multiple-perspective view of the safety catch assembly according to the disclosure.

Referring now to FIG. 2, there is depicted a multiple-perspective view of safety catch assembly 10 according to the disclosure. Safety catch assembly 10 is comprised of a safety catch fabric 20, a plurality of connection grommets 14, and a plurality of securement devices 12, 16. In the preferred embodiment of the disclosure, safety catch assembly 10 will utilize a plurality of rings 12 as a securement means. However, other embodiments may use a combination of rings 12 and carabiners 16, or any other means of securement known in the art. One embodiment of safety catch assembly 10 has at least one rigid bar 18 running adjacent to connection grommets 14, for the purpose of eliminating gaps between safety catch assembly 10 and multilevel railcar deck 44 (as hereinafter described in FIGS. 3, 4).

Figure 3:
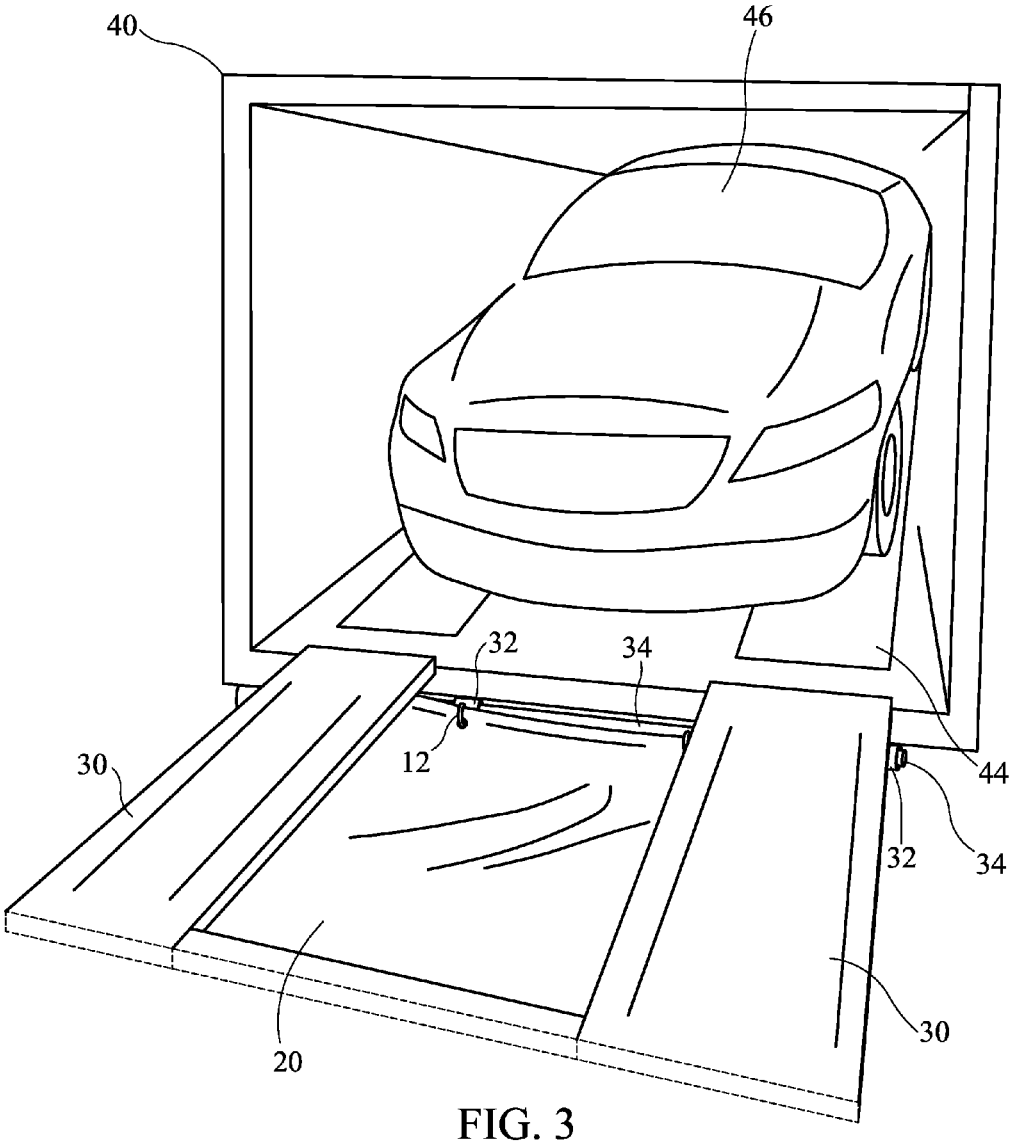
FIG. 3 is a perspective view from inside a multilevel railcar showing the multilevel railcar safety catch system according to the disclosure.

With reference now to FIG. 3, there is depicted a perspective view from inside a multilevel railcar 40 showing the multilevel railcar safety catch system according to the disclosure. Multilevel railcar 40 is shown with car 46 resting on multilevel railcar deck 44. Extending out from multilevel railcar 40 are two bridge plates 30, said bridge plates 30 coupled to multilevel railcar 40 via a plurality of barrel rings 32 and a bridge plate hinge pin 34. In the preferred embodiment, safety catch fabric 20 is coupled to bridge plates 30 and multilevel railcar deck 44 via rings 12.

Figure 4:
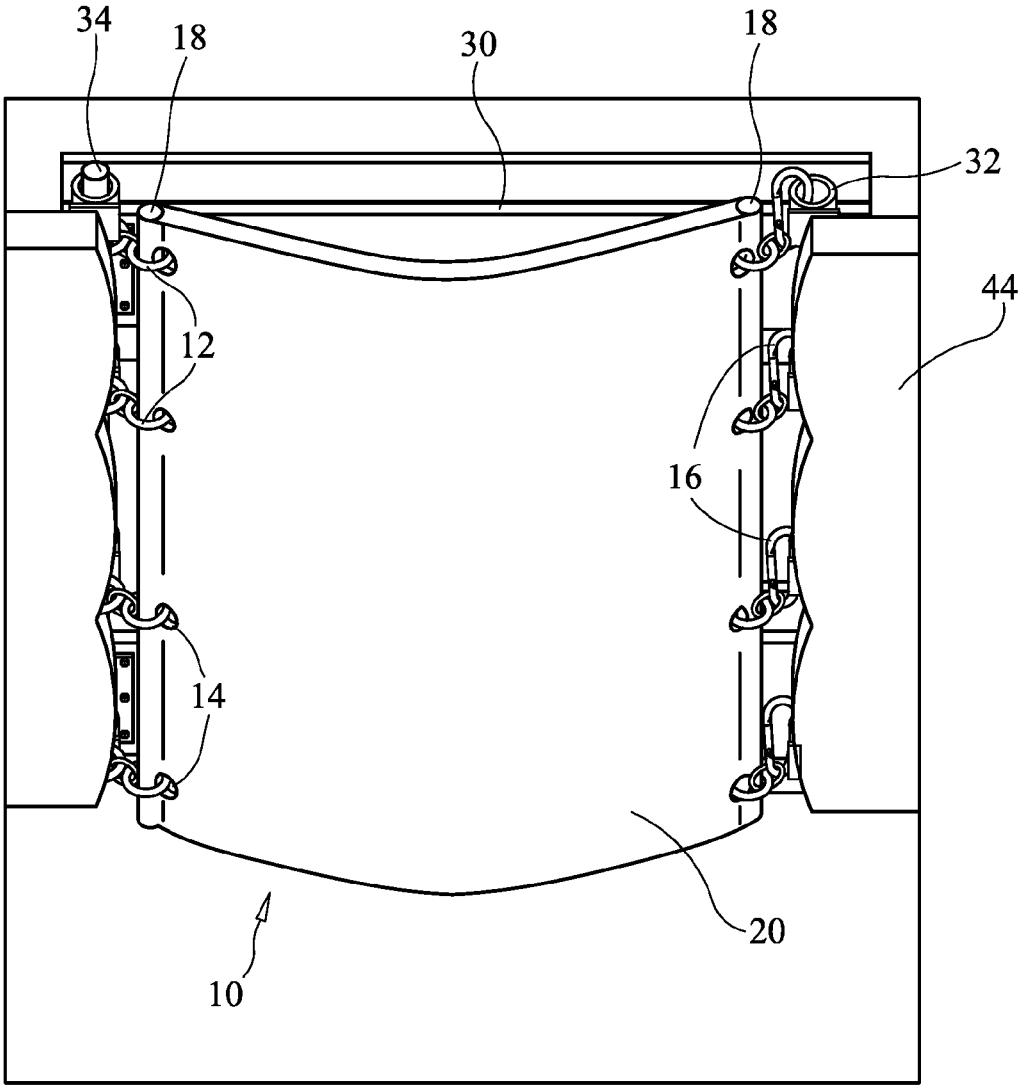
FIG. 4 is a bottom perspective view showing the multilevel railcar safety catch system according to the disclosure.

With reference now to FIG. 4, there is depicted a bottom perspective view showing the multilevel railcar safety catch system according to the disclosure. Another embodiment of safety catch assembly 10 is shown with safety catch fabric 20 coupled to multilevel railcar deck 44 and to bridge plates 30 via multiple means of securement. In the preferred embodiment, each means of securement has a ring 12 passing through a connection grommet 14, and then through another ring 12. On one side of safety catch assembly 10 as depicted in FIG. 4, an additional ring 12 is coupled to bridge plate hinge pin 34, while on the opposing side of safety catch assembly 10, a carabiner 16 is coupled to a barrel ring 32. FIG. 4 illustrates safety catch assembly 10 with rigid bars 18, which serve to tighten any gap between safety catch fabric 20, bridge plates 30 and multilevel railcar deck 44.

Figure 5:
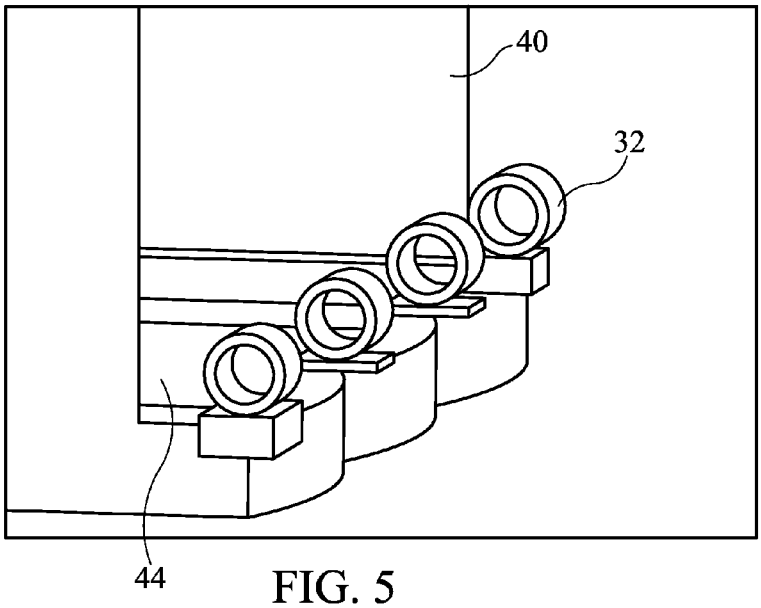
FIG. 5 is a side perspective view showing the multilevel railcar barrel rings according to the disclosure.
Figure 6:
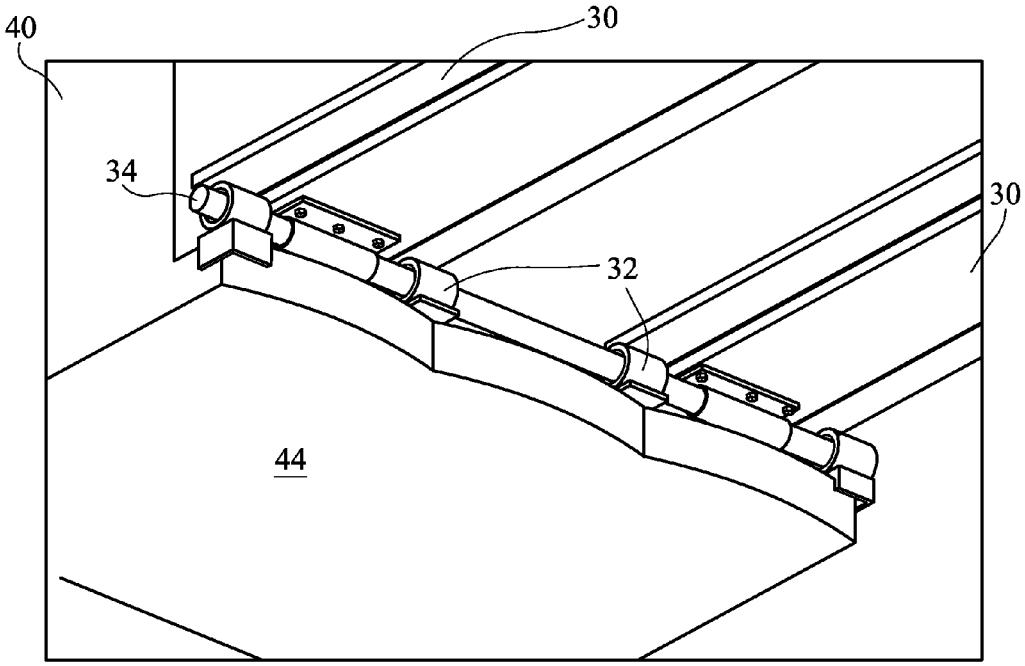
FIG. 6 is a bottom perspective view showing the bridge plates attached to the multilevel railcar via barrel rings and bridge plate hinge pin according to the disclosure.

With reference now to FIG. 5, there is depicted a side perspective view showing the multilevel railcar barrel rings according to the disclosure. A plurality of barrel rings 32 and permanently attached to multilevel railcar deck 44 of multilevel railcar 40. In the preferred embodiment of the disclosure, the barrel rings 32 are standardized by the AAR. There are generally a total of four (4) barrel rings 32 per multilevel railcar deck 44, with a distance of twenty-one and one-half inches (21.5") (equal to the standard width of a bridge plate 30, not depicted) separating the first and second barrel ring 32 depicted, as well as the third and fourth barrel ring 32 depicted. The distance between the middle two barrel rings 32 will vary slightly depending on the overall width of multilevel railcar 40, and the preferred embodiment of the safety catch assembly will fit any of the standard multilevel railcar 40 width variations. FIG. 6 illustrates a bottom perspective view of multilevel railcar 40 with bridge plates 30 attached to multilevel railcar deck 44 via barrel rings 32 and bridge plate hinge pin 34 according to the disclosure.

Figure 7:
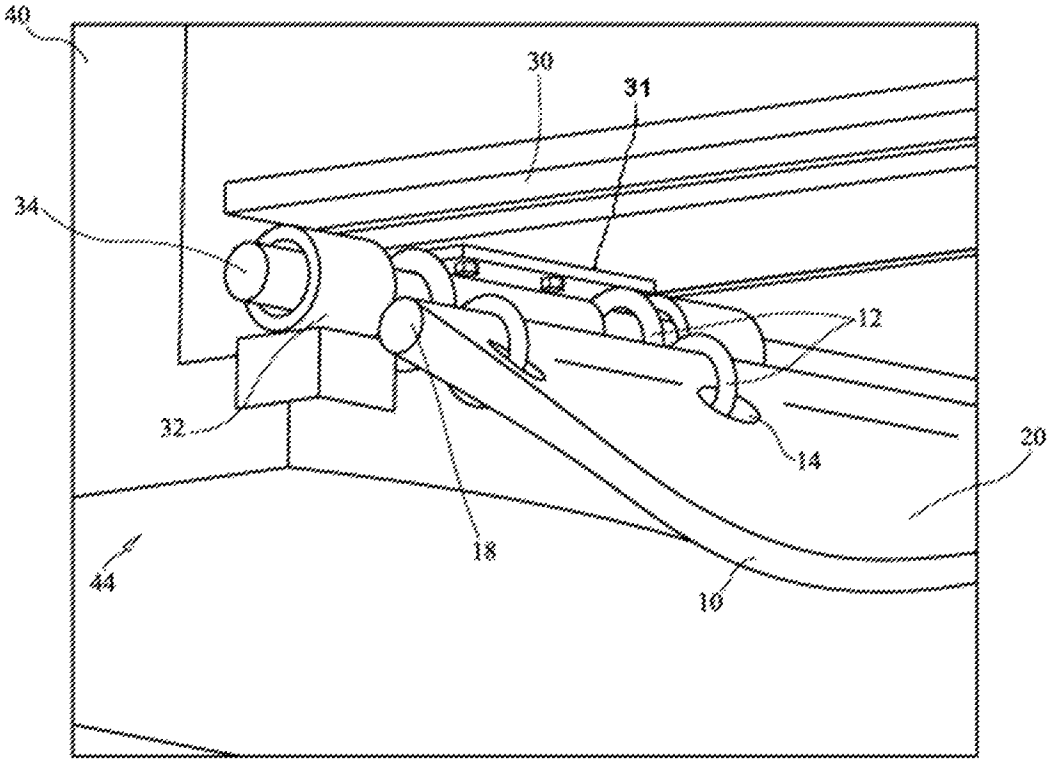
FIG. 7 is a magnified view of a section of the multilevel railcar safety catch system according to the disclosure.

With reference now to FIG. 7, there is depicted a magnified view of a section of the multilevel railcar safety catch system according to the disclosure, with multilevel railcar 40 coupled to safety catch assembly 10. Safety catch fabric 20 is shown with rings 12 passing through connection grommets 14. Additional rings 12 are used to secure safety catch assembly 10 to multilevel railcar deck 44 and bridge plate 30 via bridge plate hinge pin 34 passing through said additional rings 12. Bridgeplate hinge 31 is shown connected to bridge plate 30 and hinge pin 34. Rigid bar 18 helps to eliminate any gaps between safety catch fabric 20, multilevel railcar deck 44, and bridge plate 30.

Figure 8:
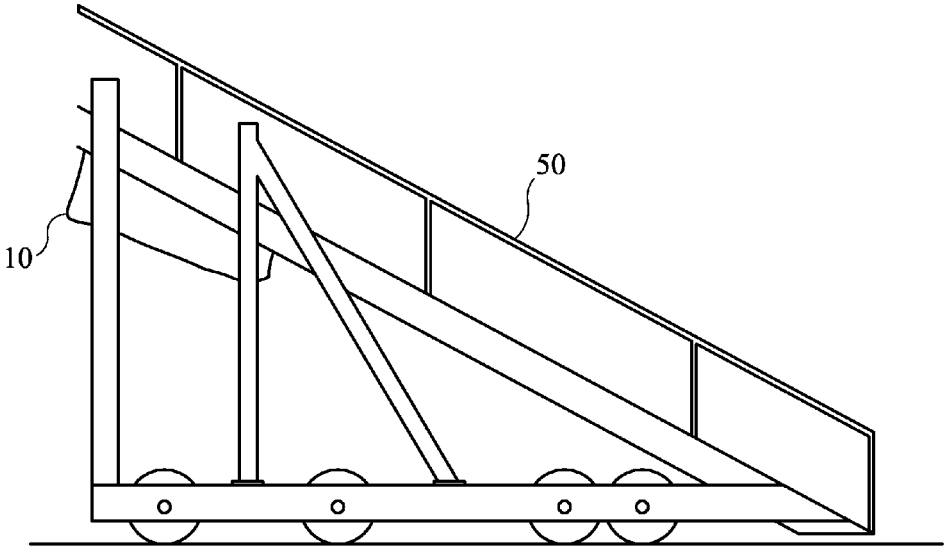
FIG. 8 is a side perspective view of a further embodiment of the multilevel railcar safety catch system according to the disclosure.
Figure 9:
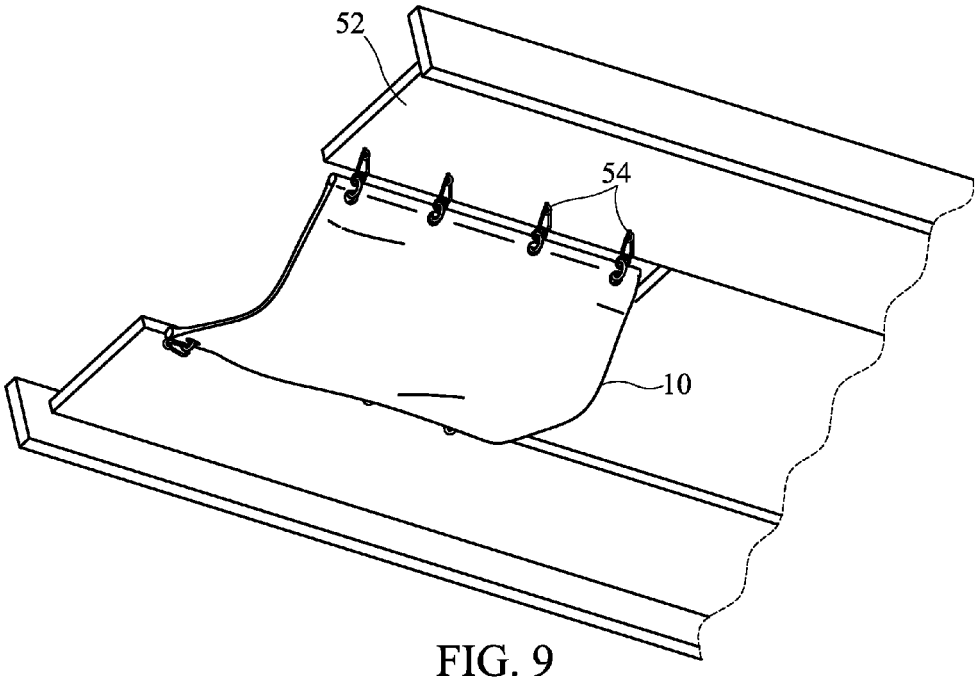
FIG. 9 is a bottom perspective view of a further embodiment of the multilevel railcar safety catch system according to the disclosure.

With reference now to FIGS. 8 and 9, there are depicted perspective views of a further embodiment of the multilevel railcar safety catch system according to the disclosure. In the present embodiment, instead of safety catch assembly 10 being used to secure a gap between multiple multilevel railcars 40 and multilevel railcar bridge plates 30, safety catch assembly 10 is used to secure a gap between the loading ramp bridge plates 52 (see FIG. 9) of vehicle loading ramp 50. In order for safety catch assembly 10 to couple with vehicle loading ramp 50, a plurality of attachment points 54 must be mounted to the underside of loading ramp bridge plates 52. Said attachment points 54 may be affixed to loading ramp bridge plates 52 using any practical means, including welding, screwing, bolting, or otherwise permanently affixing such that attachment points 54 serve to hold the weight of a person should said person fall through the gap between loading ramp bridge plates 52.

While a preferred form of this disclosure has been described above and shown in the accompanying drawings, it should be understood that applicant does not intend to be limited to the particular details described above and illustrated in the accompanying drawings, but intends to be limited only to the scope of the invention as defined by the following claims. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. A multilevel railcar safety catch system comprising:

a first of multilevel railcar having a first plurality of barrel rings;

a second multilevel railcar having a second plurality of barrel rings;

a bridge plate binge pin;

a plurality of bridge plates positionable to extend between said first multilevel railcar and said second multilevel railcar;

a safety catch assembly removably couplable to said first multilevel railcar, said second multilevel railcar, and said plurality of bridge plates such that said safety catch assembly extends between said first multilevel railcar and said second multilevel railcar below said plurality of bridge plates, whereby said safety catch assembly is adapted for catching an object or person from falling between said first multilevel railcar and said second multilevel railcar, said safety catch assembly having a safety fabric;

a first plurality of grommets located along a first edge of the safety fabric adjacent the first multilevel railcar;

a second plurality of grommets located along a second edge of the safety fabric adjacent the second multilevel railcar;

wherein each grommet from the first plurality of grommets is indirectly connected to a corresponding safety catch assembly ring selected from a first plurality of safety catch assembly rings;

wherein each of the first plurality of safety catch assembly rings is arranged to be positioned between a corresponding barrel ring and a bridge plate hinge, such that when the bridge plate hinge pin is put in place at least one of the first plurality of safety catch assembly rings is disposed on the bridge plate hinge pin between one of a first plurality of barrel rings and an adjacent one of a first plurality of hinges on the left side of the first multilevel railcar, and, at least one additional safety catch assembly ring selected from the first plurality of safety catch assembly rings is disposed on the bridge plate hinge pin between an additional barrel ring selected from the first plurality of barrel rings and an additional hinge adjacent one of the first plurality of hinges on the right side of the first multilevel railcar;

wherein each grommet from the second plurality of grommets is indirectly connected to a corresponding carabiner selected from a plurality of carabiners;

each carabiner from the plurality of carabiners being directly connected to a corresponding barrel ring selected from the second plurality of barrel rings;

wherein at least one carabiner selected from the plurality of carabiners is directly connected to a corresponding barrel ring selected from the second plurality of barrel rings on the left side of the second multilevel rail car, and at least one additional carabiner is directly connected to a corresponding barrel ring selected from the second plurality of barrel rings on the right side of the second multilevel railcar.

2. The multilevel railcar safety catch system of claim 1, further comprising a rigid bar running adjacent to the first plurality of grommets to eliminate a gap between the safety catch assembly and the first multilevel railcar.

3. The multilevel railcar safety catch system of claim 1, further comprising a rigid bar running adjacent to the second plurality of grommets to eliminate a gap between the safety catch assembly and the second multilevel railcar.

4. A multilevel railcar safety catch system comprising:

a first of multilevel railcar having a first plurality of barrel rings;

a second multilevel railcar having a second plurality of barrel rings;

a bridge plate binge pin;

a plurality of bridge plates positionable to extend between said first multilevel railcar and said second multilevel railcar;

a safety catch assembly removably couplable to said first multilevel railcar, said second multilevel railcar, and said plurality of bridge plates such that said safety catch assembly extends between said first multilevel railcar and said second multilevel railcar below said plurality of bridge plates, whereby said safety catch assembly is adapted for catching an object or person from falling between said first multilevel railcar and said second multilevel railcar;

said safety catch assembly having a safety fabric;

a first plurality of grommets located along a first edge of the safety fabric adjacent the first multilevel railcar;

a second plurality of grommets located along a second edge of the safety fabric adjacent the second multilevel railcar;

wherein each grommet from the first plurality of grommets is indirectly connected to a corresponding safety catch assembly ring selected from a third plurality of safety catch assembly rings;

a second plurality of safety catch assembly rings wherein each safety catch assembly ring from the second plurality of safety catch rings is directly connected to a corresponding safety catch ring from the third plurality of safety rings;

wherein each safety catch assembly ring from the second plurality of safety catch rings is directly connected to a safety catch ring from a first plurality of safety catch assembly rings;

wherein each of the first plurality of safety catch assembly rings has a central opening having a diameter wide enough to allow the bridge plate hinge pin to pass through;

wherein each of the first plurality of safety catch assembly rings is arranged to be positioned between an adjacent barrel ring and an adjacent bridge plate hinge and, wherein each grommet from the second plurality of grommets is indirectly connected to a corresponding carabiner selected from a plurality of carabiners;

each carabiner from the plurality of carabiners being directly connected to a corresponding barrel ring selected from the second plurality of barrel rings.

* * * * *